United States Patent [19]

Spencer et al.

[11] Patent Number: 4,768,365

[45] Date of Patent: Sep. 6, 1988

[54] PROCESS FOR PRODUCING TUNGSTEN HEAVY ALLOY SHEET

[75] Inventors: James R. Spencer, Syare; De Wayne R. Grover, Towanda, both of Pa.

[73] Assignee: GTE Products Corporation, Stamford, Conn.

[21] Appl. No.: 124,207

[22] Filed: Nov. 23, 1987

[51] Int. Cl.[4] ..... B21B 3/00; C21D 8/02

[52] U.S. Cl. ..... 72/202; 72/364; 72/700; 148/11.5 F

[58] Field of Search ..... 72/38, 199, 200, 202, 72/364, 365, 700; 148/11.5 F

[56] References Cited

U.S. PATENT DOCUMENTS 1,593,181 7/1926 Lederer ..... 148/11.5 F

FOREIGN PATENT DOCUMENTS 0209632 1/1987 European Pat. Off. ..... 72/700
114282 3/1918 United Kingdom ..... 148/11.5 F
579341 11/1977 U.S.S.R. ..... 148/11.5 F

*Primary Examiner*—E. Michael Combs
*Attorney, Agent, or Firm*—Donald R. Castle; L. Rita Quatrini

[57] ABSTRACT

A process is disclosed for producing a tungsten heavy alloy sheet which involves rolling a starting slab consisting essentially of tungsten heavy alloy wherein the tungsten content is from greater than 75% to 93% by weight tungsten by passing the slab one or more times through a rolling mill at a temperature of from 700° C. to 900° C. to reduce the height of the slab by no greater than 10% per pass to a total reduction in height of from 15% to 25%, heating the resulting slab from the first series at a temperature of 1000° C. to 1200° C. for a sufficient time to anneal the matrix of the slab, subjecting the resulting first time annealed slab to a second series of rolling operations by passing the first time annealed slab one or more times through a rolling mill at a temperature of 700° C. to 900° C. to reduce the height of the first time annealed slab by up to about 15% per pass until a total reduction in height of a maximum of about 45% from the height of the first series rolled slab is accomplished, and heating the resulting slab from the second rolling series at a temperature of 1000° C. to 1200° C. for a sufficient time to anneal the matrix of the slab. The second rolling series and the following anneals are done any number of times to produce the sheet. When the tungsten content is less than about 75% by weight, the rolling series can be done without annealing.

3 Claims, No Drawings

PROCESS FOR PRODUCING TUNGSTEN HEAVY ALLOY SHEET

BACKGROUND OF THE INVENTION

This invention relates to a process for producing tungsten heavy alloy sheet by rolling a sintered slab to the desired thickness. The correct combination of rolling temperatures, reductions per pass, annealing temperature and annealing spacing are critical to successively rolling these alloys. More particularly, a wide range of tungsten alloys can be rolled to any reduction in height desired.

Tungsten heavy alloys consist of tungsten grains surrounded by a nickel-iron-tungsten matrix. The tungsten grains are much harder than the matrix and the matrix work hardens rapidly. For these reasons it is commonly thought that rolling tungsten heavy alloys to large reductions in height would not be feasible. Rolling tungsten heavy alloys to large reductions is desirable in applications such as producing sheet from slabs.

Therefore, a process for accomplishing the rolling of tungsten heavy alloys to large reductions would be highly desirable and an advancement in the art.

SUMMARY OF THE INVENTION

In accordance with one aspect of this invention, there is provided a process is disclosed for producing a tungsten heavy alloy sheet which involves rolling a starting slab consisting essentially of tungsten heavy alloy wherein the tungsten content is from greater than about 75% to about 93% by weight tungsten by passing the slab one or more times through a rolling mill at a temperature of from about 700° C. to about 900° C. to reduce the height of the slab by no greater than about 10% per pass to a total reduction in height of from about 15% to about 25%, heating the resulting slab from the first series at a temperature of from about 1000° C. to about 1200° C. for a sufficient time to anneal the matrix of the slab, subjecting the resulting first time annealed slab to a second series of rolling operations by passing the first time annealed slab one or more times through a rolling mill at a temperature of from about 700° C. to about 900° C. to reduce the height of the first time annealed slab by up to about 15% per pass until a total reduction in height of a maximum of about 45% from the height of the first series rolled slab is accomplished, and heating the resulting slab from the second rolling series at a temperature of from about 1000° C. to about 1200° C. for a sufficient time to anneal the matrix of the slab. The second rolling series and the following anneals are done any number of times to produce the sheet.

In accordance with another aspect of the invention, when the tungsten content is less than about 75% by weight, the above described rolling steps can be carried out without the annealing steps.

DETAILED DESCRIPTION OF THE INVENTION

For a better understanding of the present invention, together with other and further objects, advantages and capabilities thereof, reference is made to the following disclosure and appended claims in connection with the above description of some of the aspects of the invention.

The starting tungsten heavy alloy slabs of the present invention consists essentially of up to 93% by weight tungsten and the balance nickel and iron with the nickel/iron ratios being from about 7/3 to about 9/1. The tungsten content is typically from about 70 to about 93% by weight.

Prior to carrying out the steps of the present invention, the alloys with tungsten contents below about 90% by weight are only solid state sintered while those with greater than about 90% by weight tungsten are liquid phase sintered. The alloy with about 90% tungsten can be rolled in either the solid state sintered or liquid state sintered condition. After sintering, all slabs are heat treated to remove hydrogen and give the slabs maximum ductility. It is not necessary that the slabs be flat or uniform in thickness as slabs with variations in up to about 20% in thickness are satisfactory starting materials for the practice of the present invention.

The starting slab is first rolled by being passed one or more times through a rolling mill. Any standard rolling mill can be used. The rolling temperatures of the present invention are from about 700° C. to about 900° C. Temperatures below about 700° C. result in age hardening when reheated for subsequent passes. Temperatures greater than about 900° C. generally result in defects between the matrix and tungsten grains. The height of the slab is reduced by no greater than about 10% with each pass through the mill. The slabs are initially soaked at the rolling temperature for a minimum of about 15 minutes to raise the temperature of the slab to the rolling temperature before the actual rolling operation. Between passes through the mill, the slabs are reheated for about 5 minutes if necessary to maintain the rolling temperature. A number of passes can be done until the slab is uniform in thickness. The total reduction in the height of the slab is from about 15% to about 25% from the starting slab.

After this first series of passes, if the tungsten content is from about 75% to about 93% by weight, the resulting slabs from this first series of rolling operations are then heated at a temperature of from about 1000° C. to about 1200° C. for a sufficient time usually from about 2 hours to about 4 hours to anneal the matrix of the slab. The annealing is done in a non-reactive atmosphere such as nitrogen. Anneals are not required for materials having less than about 75% by weight tungsten.

After the first annealing, the resulting first time annealed slab is rolled by being passed through a rolling mill one or more times as described above, except that this time there is a reduction in height of up to about 15% at each pass. Between passes, the slab is reheated if necessary for about 5 minutes to maintain the rolling temperature. The total reduction in height from this second series of rolling operations can be about 45% maximum from the height of the first series rolled slab, although the total reduction can be less than this. After this second series of rolling operations, the resulting slabs or sheets from this second series of rolling operations are heated at a temperature of from about 1000° C. to about 1200° C. for a sufficient time usually from about 1 to about 4 hours to anneal the matrix of the slab or sheet.

The second series of rolling operations and the following anneals can be repeated any number of times to reach the desired sheet thickness.

This repetition of the second series of rolling operations and anneals is done for example, in cross rolling to produce a wider sheet. In cross rolling a slab, a 1200° C. anneal should be done before changing direction.

The lower the tungsten content, the more the slab can be worked between anneals without forming major cracks in the slab or sheet.

Small or other defects that may develop during rolling can generally be removed by resintering the sheet at liquid phase temperatures. Liquid phase sintering can also be used to restore maximum ductility to the finished sheet if the tungsten content is greater than about 90% by weight.

To more fully illustrate this invention, the following non-limiting example is presented.

EXAMPLE

A slab made of tungsten heavy alloy having a weight composition of about 4.9% Ni, about 2.1% Fe and the balance W is rolled and annealed according to the following schedule.

| | Approximate Dimensions | | | R.I.H. | Total R.I.H. |
|---|---|---|---|---|---|
| | Width (in.) | Length (in.) | Thickness (in.) | (%) This pass | Since last Anneal |
| Starting Slab | 10.0 | 10.0 | 0.75 | 5 | |
| Pass 1 | 10.0 | 10.5 | 0.71 | 5 | 5 |
| Pass 2 | 10.0 | 11.0 | 0.68 | 5 | 9 |
| Pass 3 | 10.1 | 11.6 | 0.64 | 5 | 15 |
| Pass 4 | 10.1 | 12.2 | 0.61 | 5 | 18 |
| | Anneal for 2 hrs. at 1200° C. | | | | |
| Pass 5 | 10.1 | 13.5 | 0.55 | 10 | 10 |
| Pass 6 | 10.1 | 15.0 | 0.49 | 10 | 19 |
| Pass 7 | 10.1 | 16.6 | 0.45 | 10 | 27 |
| | Anneal for 2 hrs. at 1200° C. | | | | |
| Pass 8 | 10.2 | 18.4 | 0.40 | 10 | 10 |
| Pass 9 | 10.2 | 20.4 | 0.36 | 10 | 19 |
| Pass 10 | 10.2 | 22.6 | 0.32 | 10 | 27 |
| Pass 11 | 10.2 | 25.1 | 0.29 | 10 | 34 |
| | Anneal for 2 hrs. at 1200° C. | | | | |
| Pass 12 | 10.2 | 27.8 | 0.26 | 10 | 10 |
| Pass 13 | 10.3 | 30.9 | 0.24 | 10 | 19 |
| Pass 14 | 10.3 | 34.2 | 0.21 | 10 | 27 |
| Pass 15 | 10.3 | 38.0 | 0.19 | 10 | 34 |
| Pass 16 | 10.3 | 42.1 | 0.17 | 10 | 41 |
| | | | | Total R.I.H. (%) | 77 |

R.I.H. — Reduction in height

While there has been shown and described what are at present considered the preferred embodiments of the invention, it will be obvious to those skilled in the art that various changes and modifications may be made therein without departing from the scope of the invention as defined by the appended claims.

What is claimed is:

1. A process for producing a tungsten heavy alloy sheet, said process comprising:

(a) subjecting a starting slab consisting essentially of tungsten heavy alloy wherein the tungsten content is from greater than about 75% to about 93% by weight to a first series of rolling operations by passing said slab one or more times through a rolling mill at a temperature of from about 700° C. to about 900° C. to reduce the height of said slab by no greater than about 10% per pass to a total reduction in height of from about 15% to about 25%;

(b) heating the resulting slab from said first series at a temperature of from about 1000° C. to about 1200° C. for a sufficient time to anneal the matrix of said slab;

(c) subjecting the resulting first time annealed slab to a second series of rolling operations by passing said first time annealed slab one or more times through said rolling mill at a temperature of from about 700° C. to about 900° C. to reduce the height of said first time annealed slab by up to about 15% per pass until a total reduction in height of a maximum of about 45% from the height of said first series rolled slab is accomplished;

(d) heating the resulting slab from said second rolling series at a temperature of from about 1000° C. to about 1200° C. for a sufficient time to anneal the matrix of said slab; and (e) repeating steps (c) and (d) a plurality of times to produce said sheet.

2. A process of claim 1 wherein the height of said starting slab is reduced by about 3% to about 8% per pass.

3. A process for producing a tungsten heavy alloy sheet, said process comprising:

(a) subjecting a starting slab consisting essentially of tungsten heavy alloy wherein the tungsten content is from about 70% to about 75% by weight to a first series of rolling operations by passing said slab one or more times through a rolling mill at a temperature of from about 700° C. to about 900° C. to reduce the height of said slab by no greater than about 10% per pass to a total reduction in height of from about 15% to about 25%; and (b) subjecting the resulting slab from said first rolling series to a second series of rolling operations by passing said first time rolled slab one or more times through said rolling mill at a temperature of from about 700° C. to about 900° C. to reduce the height of said first time rolled slab by up to about 15% per pass until a total reduction in height of a maximum of about 45% from the height of said first series rolled slab is accomplished.

* * * * *